US011029093B2

(12) United States Patent
Shin et al.

(10) Patent No.: US 11,029,093 B2
(45) Date of Patent: Jun. 8, 2021

(54) COOLING TOWER WITH DIRECT AND INDIRECT HEAT EXCHANGER

(71) Applicant: Baltimore Aircoil Company, Inc., Jessup, MD (US)

(72) Inventors: Yoon K. Shin, Ellicott City, MD (US); David Andrew Aaron, Reisterstown, MD (US)

(73) Assignee: Baltimore Aircoil Company, Inc., Jessup, MD (US)

( * ) Notice: Subject to any disclaimer, the term of this patent is extended or adjusted under 35 U.S.C. 154(b) by 231 days.

(21) Appl. No.: 15/474,532

(22) Filed: Mar. 30, 2017

(65) Prior Publication Data

US 2018/0283792 A1 Oct. 4, 2018

(51) Int. Cl.
*F28C 1/14* (2006.01)
*F28D 9/00* (2006.01)
(Continued)

(52) U.S. Cl.
CPC ..... *F28C 1/14* (2013.01); *F28D 7/16* (2013.01); *F28D 9/0043* (2013.01); *F28F 25/04* (2013.01);
(Continued)

(58) Field of Classification Search
CPC ..... F28C 1/14; F28C 2001/006; F28D 7/16; F28D 9/0043; F28F 25/04; F28F 25/06; F28F 27/003; F28F 2025/005
(Continued)

(56) References Cited

U.S. PATENT DOCUMENTS 2,825,210 A * 3/1958 Carr ..... F28C 1/02 62/310
3,887,002 A 6/1975 Schoonman
(Continued)

FOREIGN PATENT DOCUMENTS

CN 86108431 A 10/1987
CN 1428585 A 7/2003
(Continued)

OTHER PUBLICATIONS

International Search Report and Written Opinion in corresponding application No. PCT/US2018/024625, dated Jul. 11, 2018, 15 pages.
(Continued)

*Primary Examiner* — Tho V Duong
*Assistant Examiner* — Raheena R Malik
(74) *Attorney, Agent, or Firm* — Fitch, Even, Tabin & Flannery LLP

(57) ABSTRACT

An improved heat exchange apparatus is provided with an indirect evaporative heat exchange section enclosed in a housing and a direct evaporative heat exchange section both of which are located within the same apparatus. An internal fluid stream is passed through the internal passageways of the indirect heat exchange section. An evaporative liquid is passed across the outside of the external passageways of the indirect heat exchange section to exchange heat indirectly with the internal fluid stream. The evaporative liquid that exits the indirect evaporative heat exchange section housing then passes onto and through the direct heat exchange section. The evaporative liquid exiting the direct heat exchange section is collected in a sump and then pumped upwardly to be distributed again through the indirect heat exchange section housing. The indirect heat exchange section may be comprised of a plate type heat exchanger or a
(Continued)

circuit tube type heat exchanger located within a housing. The indirect heat exchange housing may be in direct contact with the air moving through the direct heat exchange section, be in direct contact with the cool evaporative liquid, or both, to enhance the heat transfer from the indirect heat exchange section. Air may be pumped along with the evaporative liquid through the indirect heat exchange section to agitate and increase the velocity of evaporative fluid flowing through the indirect heat exchanger. Air may also be pumped into and through the indirect eat exchange section housing when the evaporative fluid pump is off during a dry mode of operation.

23 Claims, 11 Drawing Sheets

(51) Int. Cl.

| | |
|---|---|
| ***F28F 27/00*** | (2006.01) |
| ***F28D 7/16*** | (2006.01) |
| ***F28F 25/04*** | (2006.01) |
| ***F28F 25/06*** | (2006.01) |
| *F28C 1/00* | (2006.01) |
| *F28F 25/00* | (2006.01) |

(52) U.S. Cl.
CPC ..... *F28F 25/06* (2013.01); *F28F 27/003* (2013.01); *F28C 2001/006* (2013.01); *F28F 2025/005* (2013.01)

(58) Field of Classification Search
USPC ..... 165/117
See application file for complete search history.

(56) References Cited

U.S. PATENT DOCUMENTS

| | | | | |
|---|---|---|---|---|
| 4,112,027 | A | 9/1978 | Cates | |
| 4,252,751 | A * | 2/1981 | Shito | F04D 27/004 261/109 |
| 4,291,759 | A | 9/1981 | Sumitomo | |
| 4,434,112 | A | 2/1984 | Pollock | |
| 4,544,513 | A | 10/1985 | Otterbein | |
| 4,683,101 | A | 7/1987 | Cates | |
| 5,040,377 | A * | 8/1991 | Braun | F25B 49/027 165/299 |
| 5,124,087 | A | 6/1992 | Bradley | |
| 5,364,569 | A * | 11/1994 | Bugler, III | F28C 1/02 261/109 |
| 5,435,382 | A * | 7/1995 | Carter | F28C 1/14 165/110 |
| 5,600,960 | A * | 2/1997 | Schwedler | F25B 49/027 62/185 |
| 5,664,433 | A | 9/1997 | Bourne | |
| 5,832,743 | A | 11/1998 | Adamovsky | |
| 5,913,361 | A | 6/1999 | Engstroem | |
| 6,032,470 | A | 3/2000 | Haselden | |
| 6,213,200 | B1 * | 4/2001 | Carter | F28C 1/14 165/110 |
| 6,257,007 | B1 * | 7/2001 | Hartman | F25B 49/027 62/183 |
| 6,446,941 | B1 * | 9/2002 | Maheshwari | F28B 9/06 165/900 |
| 6,516,874 | B2 | 2/2003 | Mathur | |
| 6,598,862 | B2 | 7/2003 | Merrill | |
| 6,745,826 | B2 | 6/2004 | Lowenstein | |
| 7,232,116 | B2 * | 6/2007 | Stratman | F28C 1/14 261/112.1 |
| 7,484,718 | B2 * | 2/2009 | Facius | F28C 1/14 261/153 |
| 7,510,174 | B2 | 3/2009 | Kammerzell | |
| 7,887,030 | B2 * | 2/2011 | Hentschel | F28C 1/04 165/900 |
| 8,554,377 | B2 * | 10/2013 | Mathur | F28D 20/0039 700/282 |
| 9,004,463 | B2 | 4/2015 | Carter | |
| 9,057,563 | B2 | 6/2015 | Carter | |
| 9,057,564 | B2 | 6/2015 | Carter | |
| 2005/0193750 | A1 * | 9/2005 | Carter | F28C 1/14 62/171 |
| 2006/0197241 | A1 * | 9/2006 | Brenneke | F28C 1/14 261/152 |
| 2007/0240445 | A1 * | 10/2007 | Morrison | F28C 1/14 62/304 |
| 2008/0197515 | A1 * | 8/2008 | Facius | F28C 1/14 261/72.1 |
| 2009/0107661 | A1 | 4/2009 | Andersson | |
| 2009/0236084 | A1 | 9/2009 | Lau et al. | |
| 2011/0100593 | A1 | 5/2011 | Benz et al. | |
| 2013/0111928 | A1 | 5/2013 | Bemert | |
| 2013/0305752 | A1 * | 11/2013 | Martin | F24F 3/1417 62/91 |
| 2014/0096555 | A1 | 4/2014 | Ayub | |
| 2014/0166241 | A1 * | 6/2014 | Carter | F28C 1/14 165/104.14 |
| 2014/0166254 | A1 * | 6/2014 | Carter | B01F 3/04 165/166 |
| 2014/0209279 | A1 * | 7/2014 | Aaron | F28D 5/02 165/104.13 |
| 2014/0264974 | A1 * | 9/2014 | Aaron | F28D 7/087 261/128 |

FOREIGN PATENT DOCUMENTS

| | | | | |
|---|---|---|---|---|
| CN | 101251340 | A | 8/2008 | |
| CN | 105026866 | A | 11/2015 | |
| DE | 10203229 | C1 * | 4/2003 | F28D 5/02 |
| DE | 10203229 | C1 | 4/2003 | |
| FR | 1600281 | A | 7/1970 | |
| FR | 2969268 | A1 | 6/2012 | |

OTHER PUBLICATIONS

Extended European Search Report from related European Patent Application No. 18777106.8 dated Nov. 11, 2020; 7 pages.
Article: Compabloc Exchangers by Justin in Heat Transfer; http://www.virginiaheattransfer.com/content/heat-transfer/compabloc-heat-exchanger; publicly availabe before Mar. 30, 2017; 3 pages.
Custom Heat Exchangers product guide from http://xchanger.com/products/custom-heat-exchangers/; publicly available before Mar. 30, 2017; 28 pages.
Empacaduras para Intercambiadores de Calor de Placas GEA NT Series; Product guide; publicly available before Mar. 30, 2017; 2 pages.
Images of heat exchangers; publicly available before Mar. 30, 2017; 2 pages.
Kotrba, Ron; The Ins and Outs of Heat Exchangers: Capturing and reusing waste heat in biomass plants is paramount to efficient, effective operations; Biomass Magazine; Oct. 21, 2016; 3 pages.
SPX FLOW product guide; APV Hybrid Fully Welded Plate Heat Exchanger; publicly available before Mar. 30, 2017; 1 pages.
Chinese Office Action from corresponding Chinese Patent Application No. 201880021796.5 dated Aug. 18, 2020 with English translation; 24 pages.

* cited by examiner

COOLING TOWER WITH DIRECT AND INDIRECT HEAT EXCHANGER

BACKGROUND OF THE INVENTION

The present invention relates generally to an improved heat exchange apparatus such as a closed circuit fluid cooler, fluid heater, condenser, evaporator, thermal storage system, air cooler or air heater. More specifically, the present invention relates to a combination or combinations of separate indirect heat exchange sections enclosed in a housing and direct evaporative heat exchange sections arranged in the same structure to achieve improved capacity, improved performance and allowing a wet and dry mode.

The invention includes the use of a plate type or coil circuit tube type of heat exchanger as an indirect heat exchange section. Such indirect heat exchange section can be combined with a direct heat exchange section, which usually is comprised of a fill section over which an evaporative liquid such as water is transferred, usually in a downwardly streaming operation. Such combined indirect heat exchange section and direct heat exchange section together provide improved performance as an overall heat exchange apparatus such as a closed circuit fluid cooler, fluid heater, condenser, evaporator, air cooler or air heater.

Part of the improved performance of the indirect heat exchange section comprising a plate heat exchanger is the capability of the indirect heat exchange section hereinafter called a plate type heat exchanger but could can also be a coil circuit tube type heat exchanger, to provide both sensible and latent heat exchange with the evaporative liquid which is streamed or otherwise transported over and through the indirect heat exchange section. The improved performance is achieved by insuring that 100% of the plate heat exchanger is wetted while also operating at substantially higher evaporative fluid velocities resulting in higher external forced convection heat transfer coefficients relative to gravity drain indirect heat exchangers.

Various combinations of the heat exchange arrangements are possible in accordance with the present invention. Such arrangements could include an arrangement wherein the indirect heat exchange section is physically located within the arrangement and being above, adjacent or below the direct heat exchange section. In such arrangements, the indirect heat exchange section is comprised of a plate type heat exchanger located in a housing located within the evaporative heat exchanger. An internal fluid stream to be cooled, heated, evaporated or condensed is passed through the internal passageways of the plate type heat exchanger. An evaporative liquid is passed through the indirect heat exchange section housing and distributed through the external passageways of the plate type heat exchanger to indirectly exchange heat with the internal fluid stream. Due to varying heat loads, varying ambient conditions, economical needs to save energy or water and needs of heat exchange, the indirect heat exchanger of the present invention could be operated wherein both air and an evaporative liquid such as water are drawn or supplied across the indirect heat exchanger. This is accomplished by selectively pumping air into the indirect heat exchanger to travel with the evaporative liquid which causes increased agitation and evaporative fluid velocities hence increased external heat transfer coefficients while also allowing evaporative heat exchange to occur on the outside of the indirect heat exchanger. A dry mode of operation is made possible by pumping only air through the indirect heat exchange section housing in thermal contact with the outside of the internal passageways of the plate type heat exchanger to indirectly exchange heat with the internal fluid stream. Because of the increased efficiency of the indirect heat exchange section, the size of the indirect heat exchanger can be reduced thereby allowing more room for adding direct heat exchanger surface area and even allowing a larger diameter fan in some orientations both of which increase the improved heat exchanger capacity. Because the indirect heat exchange section is located within the improved arrangement and being above, adjacent or below the direct heat exchange section, either air or evaporative liquid or both are in direct contact with the housing of the indirect heat exchanger thereby increasing the heat transfer of the indirect heat exchange section.

The evaporative liquid then exits the indirect heat exchange section housing to be distributed onto and through the direct heat exchange section which is usually comprised of a fill arrangement. Air is moved over the direct heat exchange section to evaporatively cool the evaporative liquid. The evaporative liquid draining from the direct heat exchange section is typically collected in a sump and then pumped upwardly for redistribution through the indirect heat exchange section housing.

Accordingly, it is an object of the present invention to provide an improved heat exchange apparatus, which could be a closed circuit fluid cooler, fluid heater, condenser, evaporator, air cooler or air heater, which includes an indirect heat exchange section located within a housing and located above, below or adjacent to the direct heat exchanger all which are located within the improved heat exchange apparatus.

It is another object of the present invention to provide an improved heat exchange apparatus such as a closed circuit fluid cooler, fluid heater, condenser, evaporator, air cooler or air heater, including an indirect heat exchange section that comprises a plate type heat exchanger or a coil circuit tube type heat exchanger located within a housing.

It is another object of the present invention to provide an improved heat exchange apparatus such as a closed circuit fluid cooler, fluid heater, condenser, evaporator, air cooler or air heater, including an indirect heat exchange section located within a housing wherein either evaporative liquid, air or both evaporative liquid and air exchange heat with the housing of the indirect heat exchange section.

It is another object of the present invention to provide an improved heat exchange apparatus such as a closed circuit fluid cooler, fluid heater, condenser, evaporator, air cooler or air heater, including an indirect heat exchange section located within a housing wherein the customer piping between the pump and the indirect heat exchange section has been eliminated.

It is another object of the present invention to provide an improved heat exchange apparatus such as a closed circuit fluid cooler, fluid heater, condenser, evaporator, air cooler or air heater, including an indirect heat exchange section located within a housing wherein the cost of the housing is substantially reduced because of a lower pressure requirement.

It is another object of the present invention to provide an improved heat exchange apparatus such as a closed circuit fluid cooler, fluid heater, condenser, evaporator, air cooler or air heater, by decreasing the size of indirect heat exchanger while increasing the size of direct heat exchanger located within the same heat exchange apparatus while increasing the size of the fan while maintaining the size or footprint of the cooling tower in order to increase the thermal capacity and reduce the manufacturing cost for a given footprint of the cooling tower.

It is another object of the present invention to provide an improved heat exchange apparatus such as a closed circuit fluid cooler, fluid heater, condenser, evaporator, air cooler or air heater, including an indirect heat exchange section located within a housing wherein air streams are injected into the evaporative liquid of the indirect heat exchange section housing during wet operation.

It is another object of the present invention to provide an improved heat exchange apparatus such as a closed circuit fluid cooler, fluid heater, condenser, evaporator, air cooler or air heater, including an indirect heat exchange section located within a housing wherein the indirect heat exchange section may operate in a dry mode by operating an air blower that blows air through the indirect heat exchanger housing to move cold ambient air through the exterior passages of the indirect heat exchanger to indirectly and sensibly cool the internal fluid stream.

SUMMARY OF THE INVENTION

The present invention provides an improved heat exchange apparatus which typically is comprised of a combination of an indirect heat exchange section and a direct heat exchange section. The indirect heat exchange section provides improved performance by utilizing a plate type heat exchanger usually within a housing. A plurality of internal passages and external passages are formed between plates. Such plates are designed to allow an internal fluid stream to be passed through the internal passages and an evaporative liquid, air, or evaporative liquid with air to be passed through the external passages to indirectly exchange heat with the internal fluid stream within the plate heat exchanger. Such utilization of a plate heat exchanger in the closed circuit fluid cooler, fluid heater, condenser, evaporator, air cooler or air heater of the present invention provides improved performance and also allows for combined operation or alternative operation wherein only air or only an evaporative liquid or a combination of the two can be passed through or across the external passages of the plate heat exchanger. Since the housing of the indirect heat exchanger is located within the evaporative structure, the evaporative liquid moving within the housing as it is absorbing heat can be further cooled by the evaporative liquid, air, or evaporative liquid and air which is in contact and moving across the outside surface of the housing.

A direct heat exchange section is located beneath, adjacent or above the indirect heat exchange section. The evaporative liquid leaving the indirect heat exchange section housing passes onto and through the direct heat exchange section fill and accordingly allows heat to be drawn from such evaporative liquid by a passage of air across or through the direct heat exchange section fill by air moving therethrough. The evaporative liquid exiting the direct heat exchange section is collected in a sump and then pumped back for distribution through the indirect heat exchange section housing. While the sump is typically locating in the bottom of the evaporative heat exchanger, it is also possible to locate the sump remotely as is known in the art.

The present invention further concerns the design of an improved heat exchange apparatus that has a direct heat exchanger, usually a fill pack and an indirect heat exchanger, usually a plate type heat exchanger. The size of the more expensive indirect heat exchanger can be decreased while the size of the inexpensive direct heat exchanger can be increased. In addition, because some indirect and direct evaporative heat exchangers have the indirect heat exchanger and fan located at the top, the fan and indirect heat exchanger compete for precious footprint and in this improved heat exchange apparatus, since the indirect heat exchanger is smaller or located adjacent or under the direct heat exchange section, the fan diameter may be increased while maintaining the size or footprint of the cooling tower in order to increase the thermal capacity and reduce the manufacturing cost for a given footprint of the cooling tower.

The size reduction of the indirect heat exchanger can be achieved by increasing the rate of sensible heat transfer between the evaporative liquid and the indirect heat exchanger. In general, the rate of sensible heat transfer is increased when the velocity of liquid traveling across the surface of indirect heat exchanger is increased. Since the pull of gravity is constant and cannot be increased, the velocity of the evaporative liquid that is naturally flowing over the external surface of prior art indirect heat exchange sections is limited and cannot be substantially increased. Without significantly increasing this cooling tower liquid velocity, it is difficult to increase the rate of sensible heat transfer between the evaporative liquid and the surface of the indirect heat exchanger plates. In one embodiment of this invention, the plates of the indirect heat exchanger are enclosed in a water tight housing and then a pump is used to force a larger quantity of evaporative liquid into the housing and then rapidly through the plurality of passages between adjacent plates. Because the forced liquid velocity can be substantially higher than the naturally flowing liquid by gravity, a higher sensible heat transfer rate between the evaporative liquid and the external surface of the plates is achieved.

Because the indirect heat exchanger plates are typically made out of metal or of a highly conductive plastic, which is typically more expensive than the fill pack of the direct heat exchange section which are usually made of plastic, the overall manufacturing cost of the cooling tower can be reduced substantially. By increasing the rate of sensible heat transfer significantly without reducing the size of indirect heat exchanger plates significantly, the overall cooling tower's thermal capacity is increased without increasing the cooling tower footprint.

The overall cooling tower performance could additionally be increased by injecting air streams into the indirect heat exchange section housing during wet operation. The injected air stream, which becomes air bubbles inside the housing when filled with evaporative liquid, increases the heat transfer rate by both agitating and increasing the evaporative liquid's local velocity. Further, the injected air into the evaporative liquid allows evaporative heat transfer to occur in addition to sensible cooling by just the evaporative fluid alone.

In another embodiment, the indirect heat exchange section housing can be drained of evaporative liquid while still having the ability to cool the internal fluid stream within the indirect heat exchange section plate passageways. This can be achieved by operating an air blower that is attached to the plate housing to move cold ambient air through the plate housing through the passages outside the plate internal passageways to indirectly sensibly cool the internal fluid inside the plate passageways with ambient air.

DESCRIPTION OF THE PREFERRED EMBODIMENT

Figure 1:
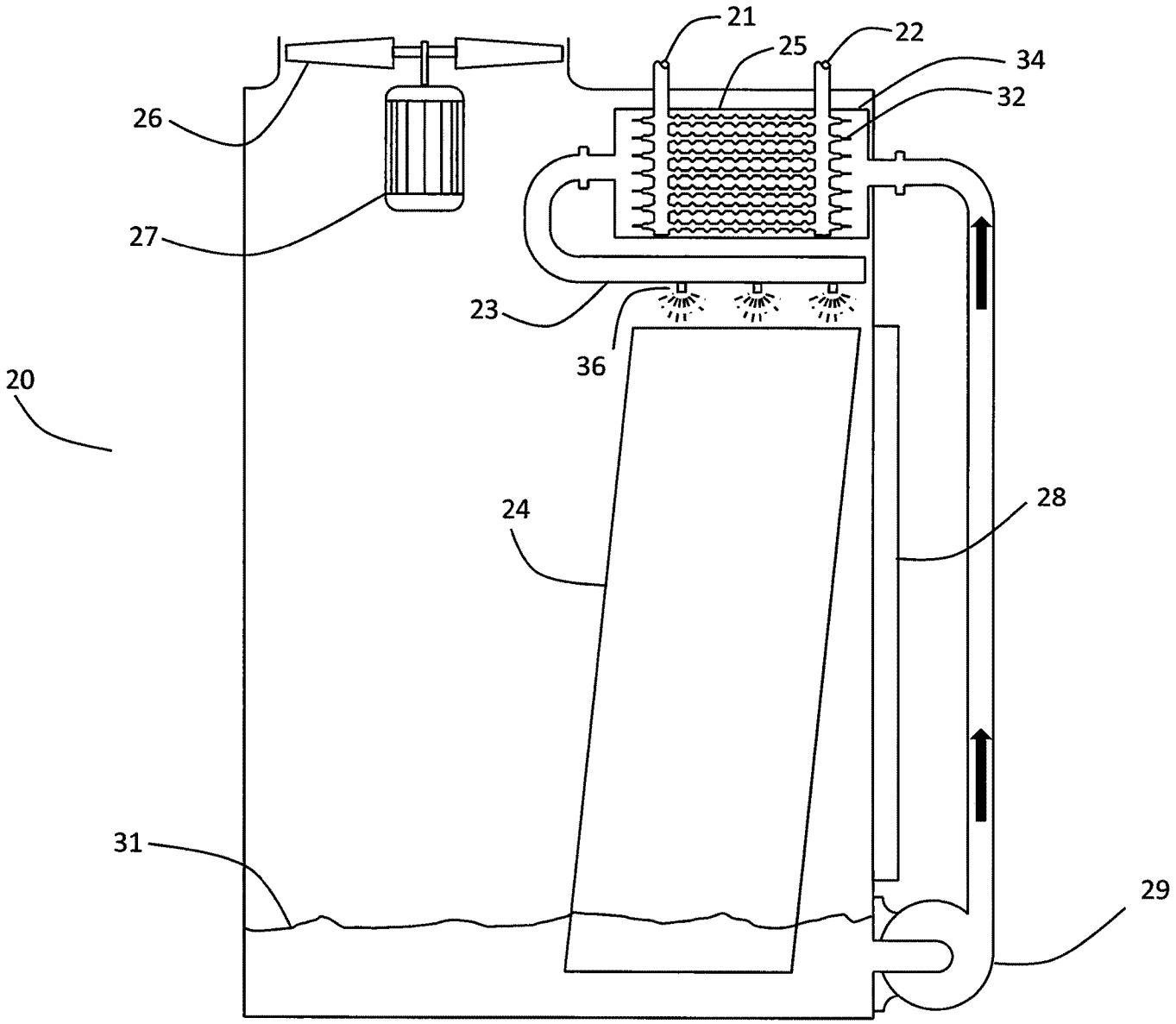
FIG. 1 is a side view of the first embodiment using a plate type heat exchanger in the housing of the indirect heat exchange section in accordance with the present invention

Referring now to FIG. 1 of the drawings, a first embodiment of the present invention is shown generally as heat exchanger 20, which is generally in the form of a closed circuit cooling tower.

Such heat exchanger generally is present in a closed circuit cooling tower with indirect heat exchange section 25 located above direct heat exchange section 24.

Direct heat exchange section 24 is typically comprised of fill usually comprised of sheets of polyvinyl chloride. Direct heat exchange section 24 receives air through air inlet 28 on the outside of heat exchanger 20, with air being drawn generally across and somewhat upwardly through direct heat exchange section 24 by fan 26 rotated by motor 27.

Indirect heat exchange section 25 is usually comprised of a plurality of plate type heat exchangers has preferably internal fluid inlet 21 and internal fluid outlet 22 and is positioned inside housing 34. It should be understood that the operation of internal fluid inlet 21 and internal fluid outlet 22 can be reversed if it is desired.

An evaporative cooling tower liquid, usually water, flows downwardly from water distribution assembly 23 such that the evaporative cooling tower liquid falls downwardly onto and through direct heat exchange section 24. While falling downwardly and through direct heat exchange section 24, a small portion of cooling tower liquid is evaporated by moving air and latent heat transfer takes place from the evaporative cooling tower liquid to air. It should be noted that in some applications, condensation takes place from air into cooling tower liquid.

The cooling tower liquid that passes downwardly and through direct heat exchange section 24 is then collected in sump 31 and is pumped by pump 29 to indirect section housing 34 and through indirect heat exchange section 25 then back to water distribution assembly 23. Water distribution assembly 23 can be comprised of a variety of pipes with openings and using orifices or spray nozzles 36 as shown in FIG. 1 or as shown in FIG. 1B, may have gravity water basin 35 with orifices or nozzles 36 or can be of other water distribution assemblies as known in the art.

In FIG. 1, indirect heat exchange section 25 is usually comprised of a plate type heat exchanger 32 but can be any type of indirect heat exchanger such as and not limited to a coil circuit tube type heat exchanger as known in the art. A fluid to be cooled, condensed, heated, or evaporated passes within the joined plates or cassettes of plate type heat exchanger 32. It should be further understood that the heat exchanger 25 can be situated in any available location within the improved heat exchange apparatus in any position because the evaporative liquid is pumped through the indirect heat exchange section. An advantage of having indirect heat exchange section 25 and direct heat exchange section 24 located within the improved heat exchanger 20 is that the piping between indirect heat exchange section 25 and water distribution assembly 23 is minimized and customer piping is eliminated. Another advantage of having indirect heat exchange section 25 and direct heat exchange section 24 located within the improved heat exchanger 20 is that indirect heat exchanger 25 is in very close proximity to water distribution assembly 23, requiring much lower pressure to pump the evaporative liquid hence the pressure rating and cost of housing 34 may be substantially reduced.

Figure 1A:
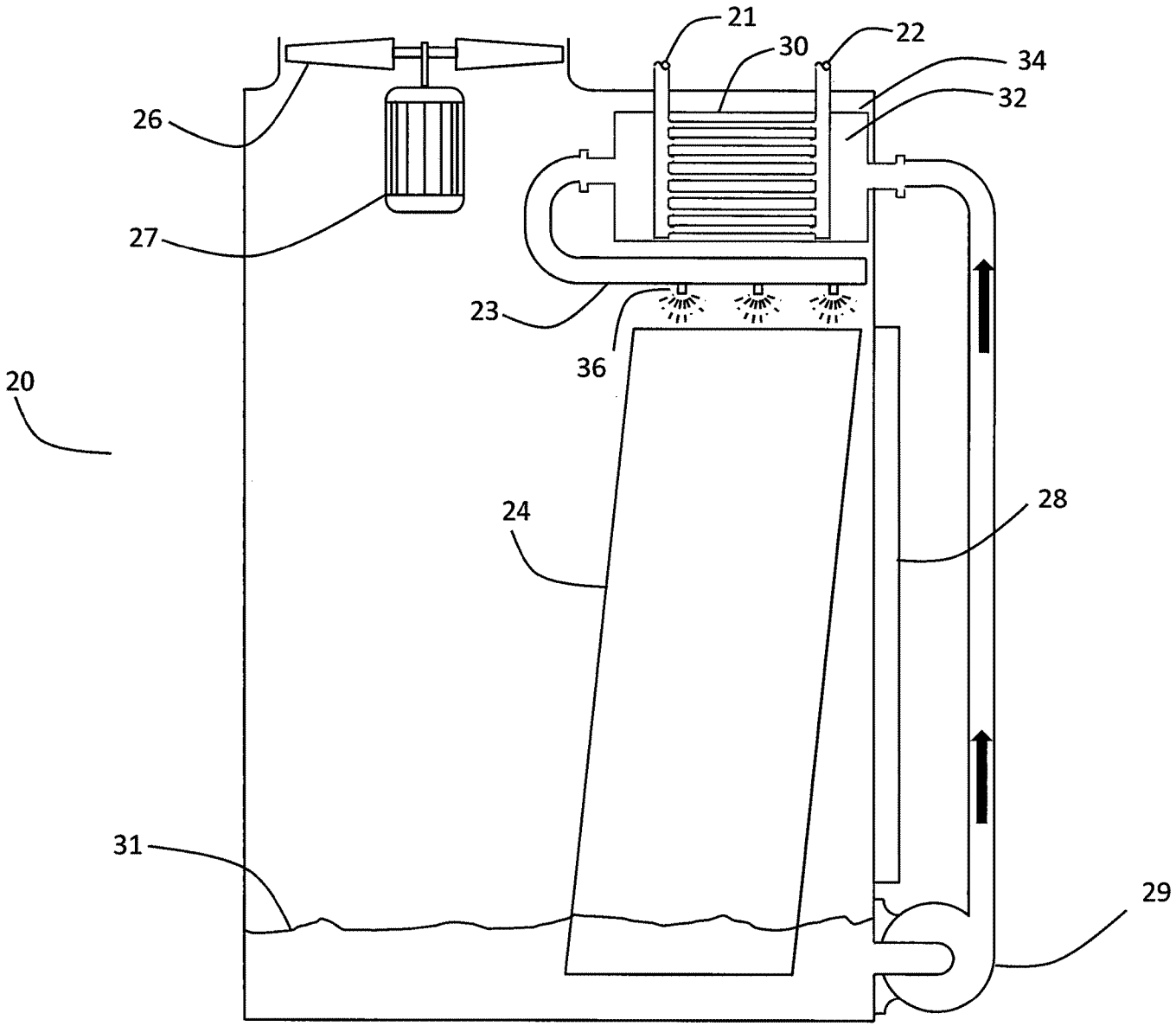
FIG. 1A is a side view of the first embodiment using a coil circuit tube type heat exchanger in the housing of the indirect heat exchange section in accordance with the present invention

In FIG. 1A, indirect heat exchanger 30 may be constructed of tubes and inlet header 22 and outlet header 21 in any configuration and material as known in the art as long as it is enclosed by housing 34.

Figure 1B:
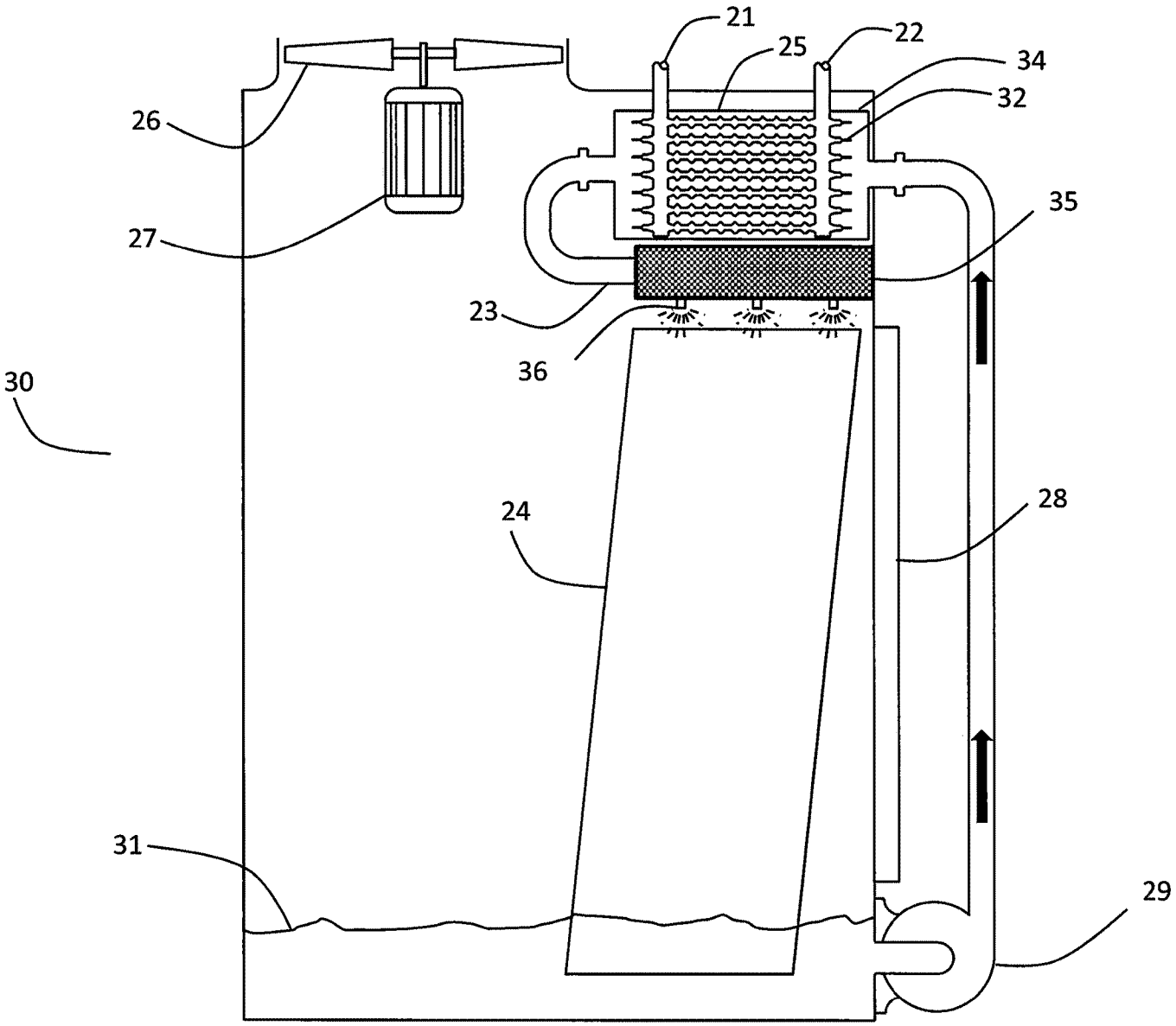
FIG. 1B is a side view of the first embodiment using a different water distribution system to direct the evaporative fluid to the direct heat exchanger in accordance with the present invention.

In FIGS. 1,1A, and 1B, fan 26 is shown to induce airflow through direct heat exchange section 24 but can also be a forced air type as known in the art and is not a limitation of the invention. This is true for all subsequent Figures as well.

Figure 2:
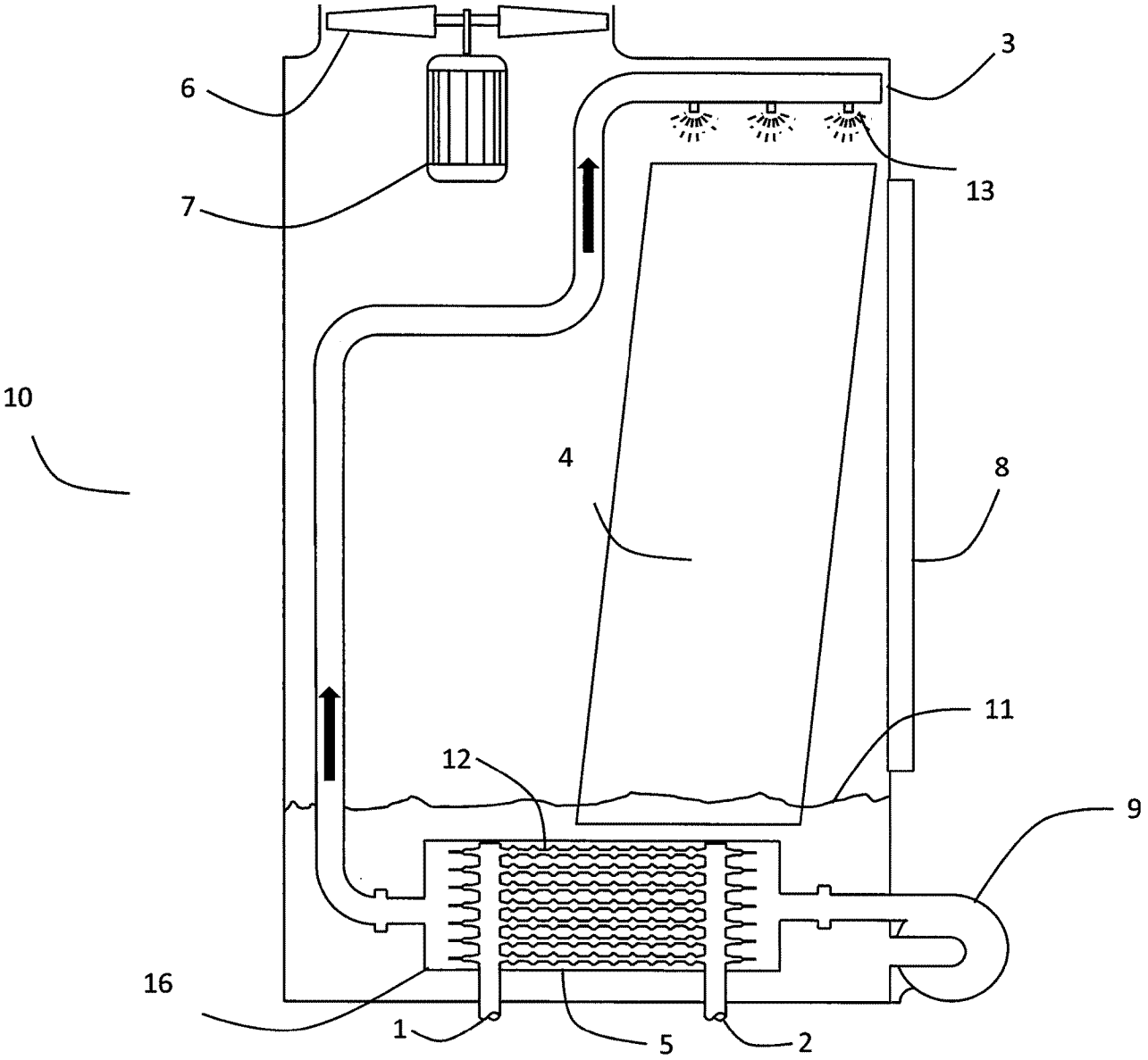
FIG. 2 is a side view of a second embodiment of a heat exchanger in accordance with the present invention.

Referring now to FIG. 2 of the drawings, a second embodiment of the present invention is shown generally as heat exchanger 10, which is generally in the form of a closed circuit cooling tower.

Such heat exchanger generally is present in a closed circuit cooling tower with indirect heat exchange section 5 located below direct heat exchange section 4. Direct heat exchange section 4 is typically comprised of fill usually comprised of sheets of polyvinyl chloride. Direct heat exchange section 4 receives air through air inlet 8 on the outside of heat exchanger 10, with air being drawn generally across and somewhat upwardly through direct heat exchange section 4 by fan 6 rotated by motor 7.

Indirect heat exchange section 5 is usually comprised of plate type heat exchanger 12 having fluid inlet 1 and fluid outlet 2 and is positioned inside housing 16. It should be understood that fluid inlet 1 and fluid outlet 2 can be reversed if it is desired.

An evaporative cooling tower liquid, usually water, flows downwardly from water distribution assembly 3 such that the cooling tower liquid falls downwardly onto and through direct heat exchange section 4. While falling downwardly and through direct heat exchange section 4, a small portion of cooling tower liquid is evaporated by moving air and latent heat transfer takes place from the evaporative cooling tower liquid to air. It should be noted that in some applications, condensation takes places from air into cooling tower liquid.

The evaporative cooling tower liquid that passes downwardly and through direct heat exchange section 4 and collected in sump 11 is pumped by pump 9 to indirect heat exchange housing 16 and through indirect heat exchange section 5 then back to water distribution assembly 3. Water distribution assembly 3 can be comprised of a variety of pipes with openings or nozzles 13 as shown, or any other water distribution arrangement such as using spray nozzles, troughs, or other water distribution assemblies.

Indirect heat exchange section 5 enclosed in housing 16 is usually comprised of a plurality of plate type heat exchangers 12 but can be any type of indirect heat exchanger such as and not limited to a coil circuit tube type heat exchanger as known in the art. A fluid to be cooled, condensed, heated, or evaporated passes within the joined plates or cassettes of plate type heat exchanger 12.

An advantage of placing indirect heat exchange section 5 into sump 11 is that evaporative cooling tower water flows over the surface of the housing 16 of indirect heat exchange section 5 and heat transfer takes place because the cold water in sump 11 cools the surface of housing 16 of indirect heat exchange section 5 further cooling the fluid within the plurality of plates 12. When heat transfer takes place between housing 16 and sump water 11, sump water 11 becomes hotter and the sump water top surface can be used as an added evaporative surface to the fill and increase the overall efficiency of the cooling tower.

Indirect heat exchange section 5 may be either fully or partially submerged in cold water sump 11. Another advantage of placing indirect heat exchange section 5 into sump 11 is that there is room now for a larger or taller direct heat exchange section 4 thereby increasing the capacity of the unit. An advantage of having indirect heat exchange section 5 and direct heat exchange section 4 located within the improved heat exchanger 10 is that the piping between indirect heat exchange section 5 and water distribution assembly 3 is minimized and customer piping is eliminated.

Figure 3:
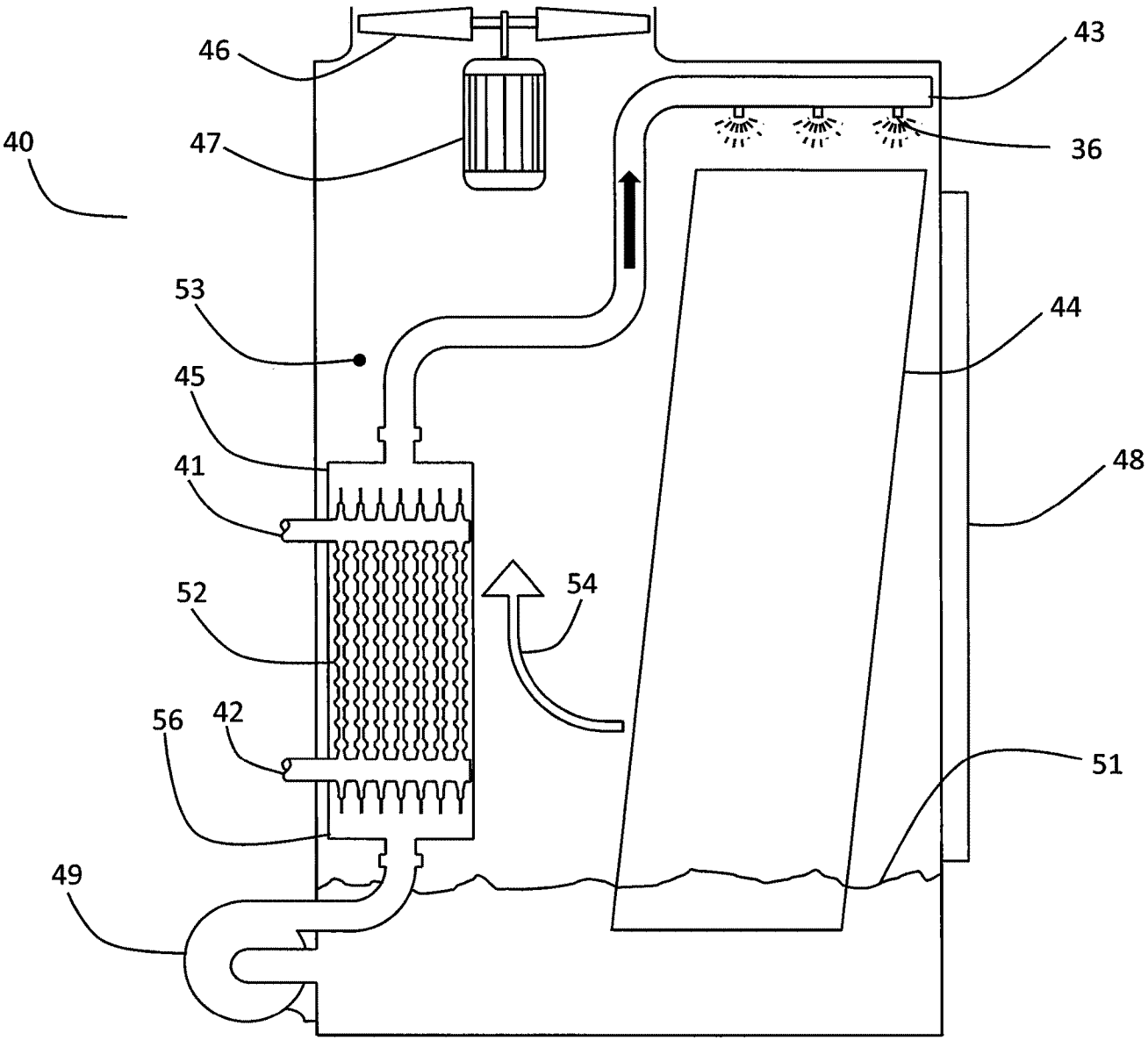
FIG. 3 is a side view of a third embodiment of a heat exchanger in accordance with the present invention.

Referring now to FIG. 3 of the drawings, a third embodiment of the present invention is shown generally as heat exchanger 40, which is generally in the form of a closed circuit cooling tower.

Such heat exchanger generally is present in a closed circuit cooling tower with indirect heat exchange section 45 located in air plenum 53 next to and toward the lower half of direct heat exchange section 44. It should be understood that positioning indirect heat exchange section 45 in the air plenum 53 adjacent to direct heat exchanger 44, allows for easier access and cleaning of indirect heat exchanger 45 while allowing a larger size (full height) direct heat exchange section 44 in the design.

Direct heat exchange section 44 is typically comprised of fill usually comprised of sheets of polyvinyl chloride. Direct heat exchange section 44 receives air through air inlet 48 on the outside of heat exchanger 40, with air being drawn generally across and somewhat upwardly through direct heat exchange section 44 by fan 46 rotated by motor 47.

Indirect heat exchange section 45 is usually comprised of a plurality of plate type heat exchangers 52 having fluid inlet 41 and fluid outlet 42 and positioned inside housing 56. It should be understood that the operation of fluid inlet 41 and fluid outlet 42 can be reversed if it is desired.

An evaporative cooling tower liquid, usually water, flows downwardly from water distribution assembly 43 such that the evaporative cooling tower liquid falls downwardly onto and through direct heat exchange section 44. While falling downwardly and through direct heat exchange section 44, a small portion of cooling tower liquid is evaporated by moving air and latent heat transfer takes place from cooling tower liquid to air. It should be noted that in some applications, condensation takes places from air into cooling tower liquid.

The evaporative cooling tower liquid that passes downwardly onto and through direct heat exchange section 44 and collected in sump 51 is pumped by pump 49 to indirect heat exchange housing 56 and through indirect heat exchange section 45 then back to water distribution assembly 43. Water distribution assembly 43 can be comprised of a variety of pipes with openings or nozzles 36, or be of any other water distribution arrangement such as using spray nozzles, troughs, or other water distribution assemblies.

Indirect heat exchange section 45 is usually comprised of a plurality of plate type heat exchangers 52 but can be any type of indirect heat exchanger such as and not limited to a coil circuit tube type heat exchanger as known in the art. A fluid to be cooled, condensed, heated, or evaporated passes within the joined plates or cassettes of plate type heat exchangers 52.

Air 54 exits from direct heat exchange section 44 and flows into discharge air plenum 53 on the way to fan 46 then flows over the surface of housing 56 of indirect heat exchange section 45 and heat transfer takes place. In the case in which direct heat exchange section 44 is used to cool evaporative cooling tower liquid, air 54 cools the surface of housing 56 of indirect heat exchange section 45, which is an added benefit from placing heat exchanger 45 in discharge air plenum 53. It is possible to mount the indirect section at any height within air plenum 53 where the air will be in heat exchange with housing 56.

An advantage of having indirect heat exchange section 45 and direct heat exchange section 44 located within the improved heat exchanger 40 is that the piping between indirect heat exchange section 45 and water distribution assembly 43 is minimized and customer piping is eliminated.

Figure 4:
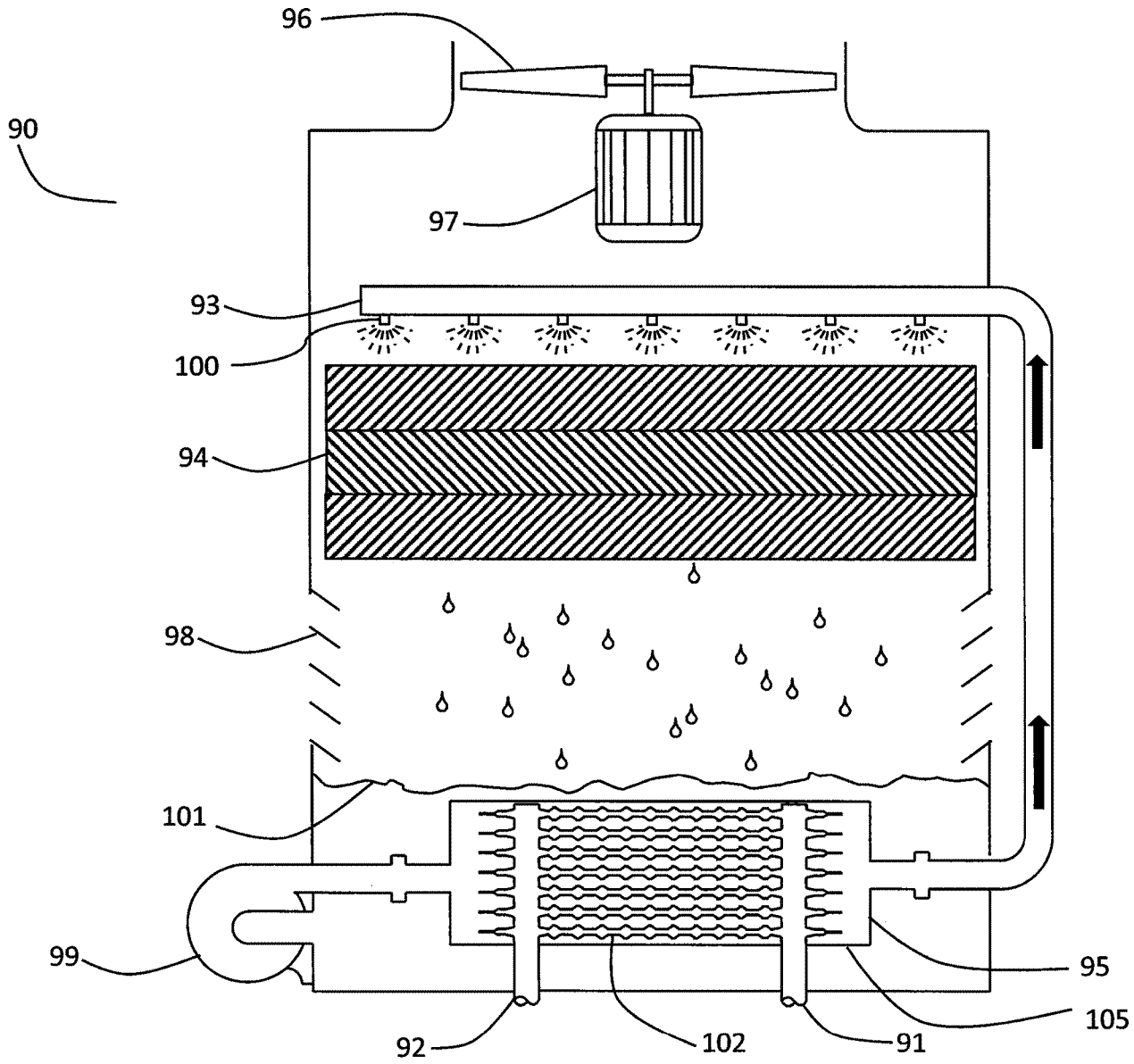
FIG. 4 is a side view of a fourth embodiment of a heat exchanger in accordance with the present invention.

Referring now to FIG. 4 of the drawings, a fourth embodiment of the present invention is shown generally as heat exchanger 90, which is generally in the form of a closed circuit cooling tower.

Such heat exchanger generally is present in a closed circuit cooling tower with direct heat exchange section 94 underneath water distribution assembly 93 with indirect heat exchange section 95 located in sump 101.

Direct heat exchange section 94 is typically comprised of fill usually comprised of sheets of polyvinyl chloride. Direct heat exchange section 94 receives air through air inlets 98 on the outside of heat exchanger 90, with air being drawn generally upwardly through direct heat exchange section 94 by fan 96 rotated by motor 97.

Indirect heat exchange section 95 is usually comprised of a plurality of plate type heat exchangers 102 having fluid inlet 91 and fluid outlet 92 positioned in housing 105. It should be understood that the operation of fluid inlet 91 and fluid outlet 92 can be reversed if it is desired.

An evaporative cooling tower liquid, usually water, flows downwardly from water distribution assembly 93 such that the cooling tower liquid falls downwardly onto and through direct heat exchange section 94. While falling downwardly onto and through direct heat exchange section 94, a small portion of cooling tower liquid is evaporated by moving air and latent heat transfer takes place from cooling tower liquid to air. It should be noted that in some applications, condensation takes places from air into cooling tower liquid.

The cooling tower liquid that passes downwardly onto and through direct heat exchange section 94 and collected in sump 101 is pumped by pump 99 to housing 105 then through indirect heat exchange section 95 then back to water distribution assembly 93. Water distribution assembly 93 can be comprised of a variety of pipes with openings or nozzles 100, or any other water distribution arrangement such as using spray nozzles, troughs, or other water distribution assemblies.

Indirect heat exchange section 95 is usually comprised of a plurality of plate type heat exchangers 102 but can be any type of indirect heat exchanger such as and not limited to a coil circuit tube type heat exchanger as known in the art. A fluid to be cooled, condensed, heated, or evaporated passes within the joined plates or cassettes of plate type heat exchanger 102.

It can be noted that by placing the indirect heat exchange section 95 under the direct heat exchange section 94, there is room for a greater size (taller) direct heat exchange section 94. An advantage of placing indirect heat exchange section 95 into sump 101 is that cold evaporative cooling tower water flows over the surface of the housing 105 of indirect heat exchange section 95 and heat transfer takes place. In the case in which direct heat exchange section 94 is used to cool the evaporative cooling tower liquid, the cold water in sump 101 cools the surface of housing 105 of indirect heat exchange section 95 further cooling the fluid within the plurality of plates 102 which is an added benefit. Indirect heat exchange section 95 may be either fully or partially submerged in cold water sump 101.

An advantage of having indirect heat exchange section 95 and direct heat exchange section 94 located within the improved heat exchanger 90 is that the piping between indirect heat exchange section 95 and water distribution assembly 93 is minimized and customer piping is eliminated.

Figure 5:
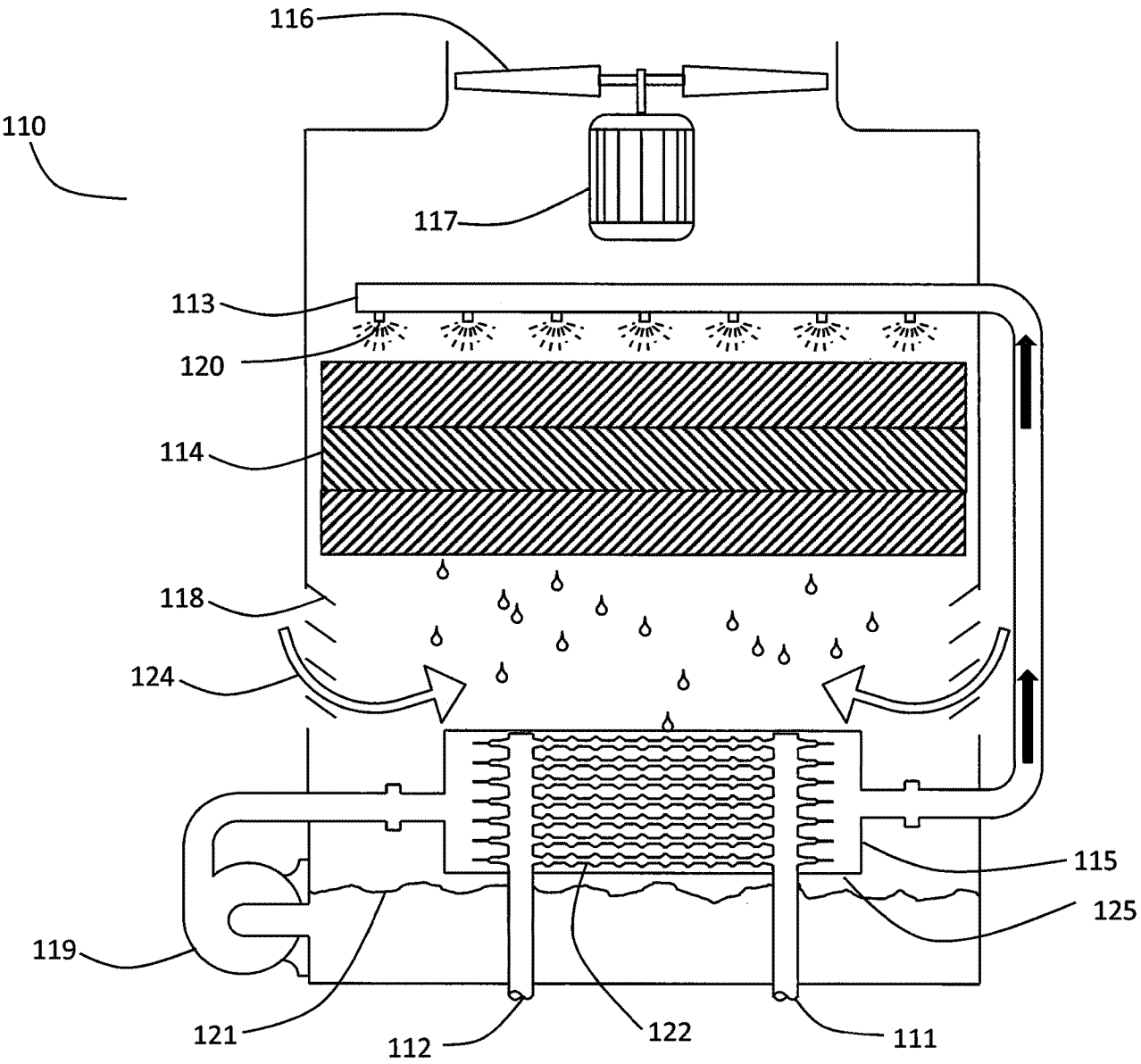
FIG. 5 is a side view of a fifth embodiment of a heat exchanger in accordance with the present invention.

Referring now to FIG. 5 of the drawings, a fifth embodiment of the present invention is shown generally as heat exchanger 110, which is generally in the form of a closed circuit cooling tower.

Such heat exchanger generally is present in a closed circuit cooling tower with indirect heat exchange section 115 located underneath direct heat exchanger 114 and at least partially above the pool of evaporative cooling tower liquid in sump 121.

Direct heat exchange section 114 is typically comprised of fill usually comprised of sheets of polyvinyl chloride. Direct heat exchange section 114 receives air through air inlets 118 on the outside of heat exchanger 110, with air being drawn generally upwardly through direct heat exchange section 114 by fan 116 rotated by motor 117.

Indirect heat exchange section 115 is usually comprised of a plurality of plate type heat exchangers 122 having fluid inlet 111 and fluid outlet 112 and positioned inside housing 125. It should be understood that the operation of fluid inlet 111 and fluid outlet 112 can be reversed if it is desired.

An evaporative cooling tower liquid, usually water, flows downwardly from water distribution assembly 113 such that the cooling tower liquid falls downwardly onto and through direct heat exchange section 114. While falling downwardly onto and through direct heat exchange section 114, a small portion of cooling tower liquid is evaporated by moving air and latent heat transfer takes place from cooling tower liquid to air. It should be noted that in some applications, condensation takes places from air into cooling tower liquid.

The evaporative cooling tower liquid that passes downwardly onto and through direct heat exchange section 114 and collected in sump 121 is pumped by pump 119 to housing 125 through indirect heat exchange section 115 then back to water distribution assembly 113. Water distribution assembly 113 can be comprised of a variety of pipes with openings, orifices or nozzles 120, or any other water distribution arrangement such as using spray nozzles, troughs, or other water distribution assemblies.

Indirect heat exchange section 115 is usually comprised of a plurality of plate type heat exchangers 122 but can be any type of indirect heat exchanger such as and not limited to a coil circuit tube type heat exchanger as known in the art. A fluid to be cooled, condensed, heated, or evaporated passes within the joined plates or cassettes of plate type heat exchanger 122.

Some of the air entering through air inlet 118 on the way to direct heat exchange section 114 blows over and cools the surface of housing 125 of indirect heat exchange section 115 which in turn further cools plate type heat exchangers 122.

An advantage of having indirect heat exchange section 115 and direct heat exchange section 114 located within the improved heat exchanger 110 is that the piping between indirect heat exchange section 115 and water distribution assembly 113 is minimized and customer piping is eliminated.

Figure 6:
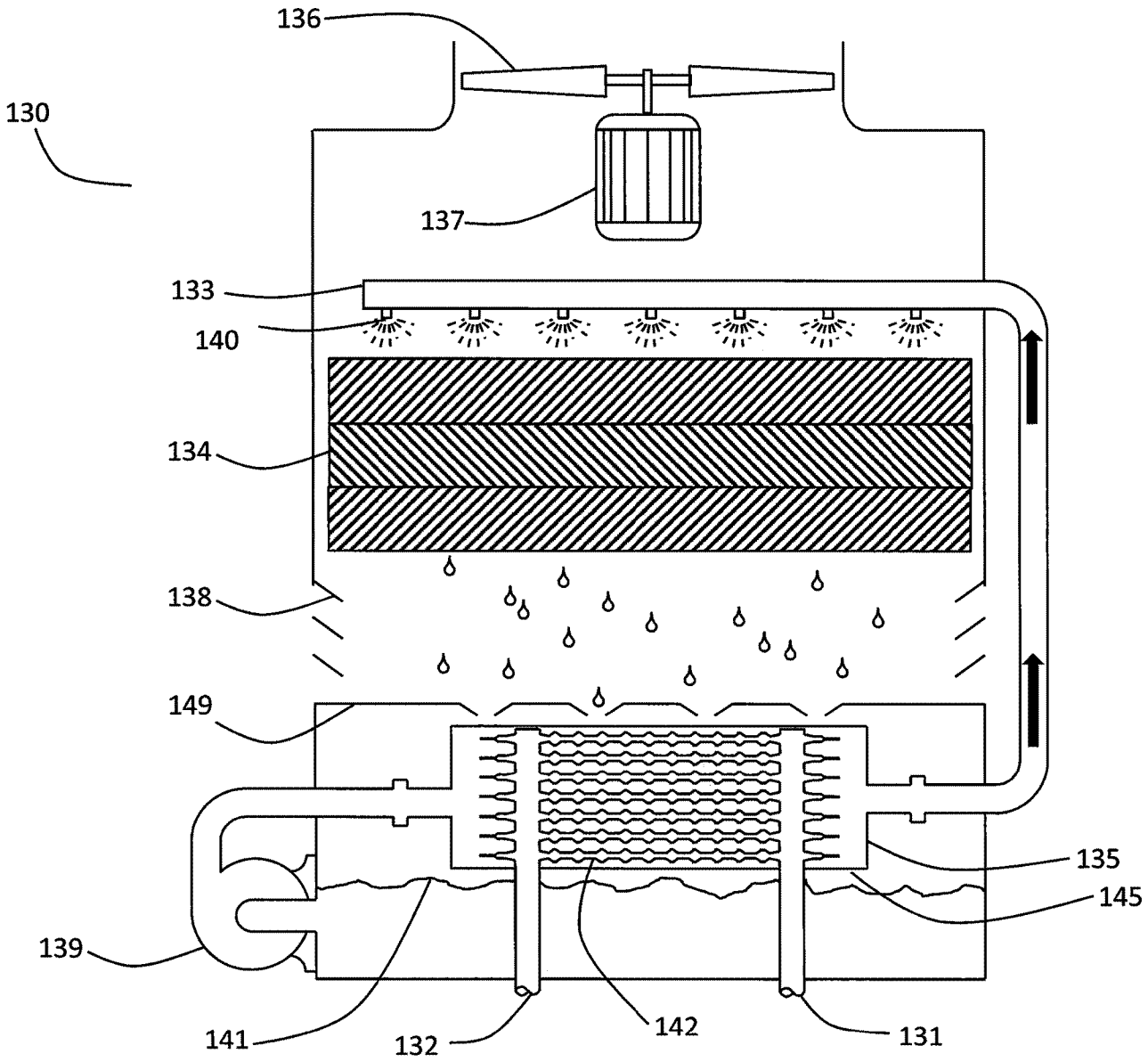
FIG. 6 is a side view of a sixth embodiment of a heat exchanger in accordance with the present invention.

Referring now to FIG. 6 of the drawings, a sixth embodiment of the present invention is shown generally as heat exchanger 130, which is generally in the form of a closed circuit cooling tower.

Such heat exchanger generally is present in a closed circuit cooling tower with direct heat exchange section 134 underneath water distribution assembly 133 indirect heat exchange section 135 located underneath redistribution pan 149 and positioned above cooling tower liquid in sump 141.

Direct heat exchange section 134 is typically comprised of fill usually comprised of sheets of polyvinyl chloride. Direct heat exchange section 134 receives air through air inlets 138 on the outside of heat exchanger 130, with air being drawn generally upwardly through direct heat exchange section 134 by fan 136 rotated by motor 137.

Indirect heat exchange section 135 is usually comprised of a plurality of plate type heat exchangers 142 having fluid inlet 131 and fluid outlet 132 and positioned inside housing 145. It should be understood that the operation of fluid inlet 131 and fluid outlet 132 can be reversed if it is desired.

An evaporative cooling tower liquid, usually water, flows downwardly from water distribution assembly 133 such that the cooling tower liquid falls downwardly onto and through direct heat exchange section 134. While falling downwardly onto and through direct heat exchange section 134, a small portion of cooling tower liquid is evaporated by moving air and latent heat transfer takes place from cooling tower liquid to air. It should be noted that in some applications, condensation takes places from air into cooling tower liquid.

The evaporative cooled cooling tower liquid that passes downwardly onto and through direct heat exchange section 134 gets collected in redistribution pan 149 and is re-sprayed onto indirect heat exchange section housing 145. The redistribution pan 149 guides the evaporative cooling tower water over housing 145 such that the housing is cooled and indirectly helps to cool indirect heat exchange section 135. The evaporative cooling tower liquid is then collected in sump 141 and is pumped by pump 139 to housing 145 then through indirect heat exchange section 135 then back to water distribution assembly 133. Water distribution assembly 133 can be comprised of a variety of pipes with openings, orifices or nozzles 140, or any other water distribution arrangement such as using spray nozzles, troughs, or other water distribution assemblies.

Indirect heat exchange section 135 is usually comprised of a plurality of plate type heat exchangers 142 but can be any type of indirect heat exchanger such as and not limited to a coil circuit tube type heat exchanger as known in the art. A fluid to be cooled, condensed, heated, or evaporated passes within the joined plates or cassettes of plate type heat exchanger 142.

An advantage of having indirect heat exchange section 145 and direct heat exchange section 134 located within the improved heat exchanger 130 is that the piping between indirect heat exchange section 145 and water distribution assembly 133 is minimized and customer piping is eliminated.

Figure 7:
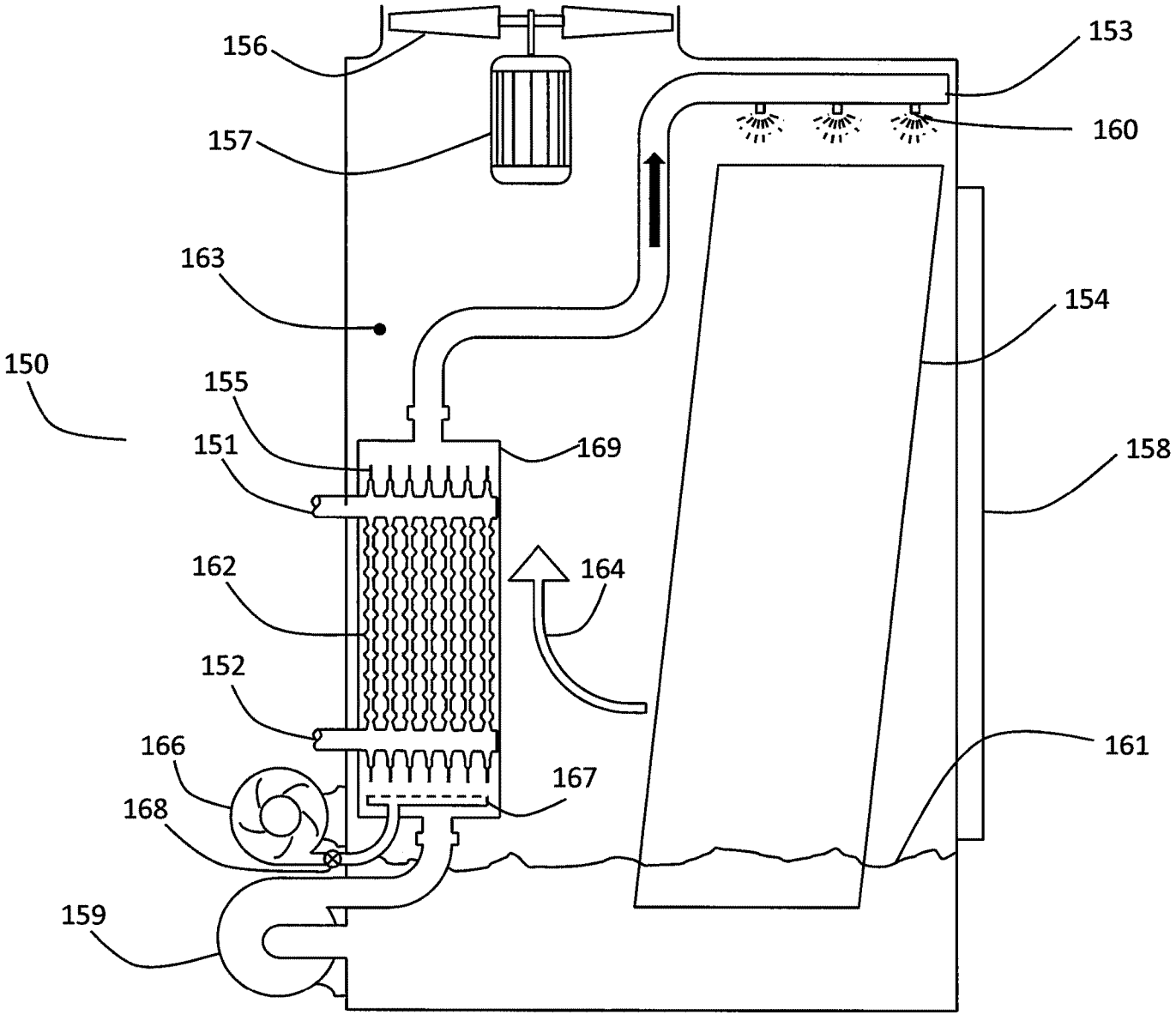
FIG. 7 is a side view of a seventh embodiment of a heat exchanger in accordance with the present invention.

Referring now to FIG. 7 of the drawings, a seventh embodiment of the present invention is shown generally as heat exchanger 150, which is generally in the form of a closed circuit cooling tower.

Such heat exchanger generally is present in a closed circuit cooling tower with indirect heat exchange section 155 located in plenum 163 adjacent to and towards the lower half of direct heat exchange section 154. It should be noted that indirect heat exchanger 155 can be located above, below or adjacent to direct heat exchanger 154 as shown in other Figures but is presented as adjacent to direct heat exchanger 154 for illustrative purposes.

Direct heat exchange section 154 is typically comprised of fill usually comprised of sheets of polyvinyl chloride. Direct heat exchange section 154 receives air through air inlet 158 on the outside of heat exchanger 150, with air being drawn generally across and somewhat upwardly through direct heat exchange section 154 by fan 156 rotated by motor 157.

Indirect heat exchange section 155 is usually comprised of a plurality of plate type heat exchangers 162 having fluid inlet 151 and fluid outlet 152. It should be understood that the operation of fluid inlet 151 and fluid outlet 152 can be reversed if it is desired.

An evaporative cooling tower liquid, usually water, flows downwardly from water distribution assembly 153 such that the evaporative cooling tower liquid falls downwardly onto and through direct heat exchange section 154. While falling downwardly onto and through direct heat exchange section 154, a small portion of cooling tower liquid is evaporated by moving air and latent heat transfer takes place from cooling tower liquid to air. It should be noted that in some applications, condensation takes places from air into cooling tower liquid.

The evaporative cooling tower liquid that passes downwardly onto and through direct heat exchange section 154 and collected in sump 161 is pumped by pump 159 to housing 169 then through indirect heat exchange section 155 then back to water distribution assembly 153. Water distribution assembly 153 can be comprised of a variety of pipes with openings, orifices or nozzles 160, or any other water distribution arrangement such as using spray nozzles, troughs, or other water distribution assemblies.

Indirect heat exchange section 155 is positioned in housing 169 and is usually comprised of a plurality of plate type heat exchangers 162. A fluid to be cooled, condensed, heated, or evaporated passes within the joined plates or cassettes of plate type heat exchangers 162.

Air 164 exits from direct heat exchange section 154 into plenum 163 on the way to fan 156 and flows over housing 169 of indirect heat exchange section 155 and heat transfer takes place. In the case in which direct heat exchange section 154 is used to cool the evaporative cooling tower liquid, air 164 cools housing 169 of indirect heat exchange section 155, which in turn cools the evaporative cooling tower liquid and plate type heat exchanger 162 inside indirect heat exchange section 155.

In embodiment 150, air pump 166 is attached to heat exchanger 150 and supplies pressurized ambient air to air distribution tube 167 inside and near the bottom of housing 169 and indirect heat exchange section 155. It is to be noted that the source of pressurized air also could be the facility that uses heat exchanger 150 such as from an available pressured air source. Check valve 168 prevents evaporative cooling tower liquid from flowing into air pump 166 when air pump 166 is turned off. During operation streams of air bubbles come out from air distribution tube 167 and travel upward with evaporative cooling tower liquid that is pumped by pump 159. Injecting air bubbles into the evaporative cooling tower liquid that travels through the plurality of liquid passages within plurality plate type heat exchangers 162 increases the agitation and increases the velocity of the evaporative cooling tower liquid and also serves to enhance the heat transfer between the cooling tower water/air mixture compared to the evaporative cooling tower water alone. With the evaporative cooling tower liquid traveling at a higher speed, the sensible heat transfer rate between the evaporative cooling tower liquid and the surface of plurality of plate type heat exchangers 162 increases, and with the presence of air bubbles in the evaporative cooling tower liquid, latent heat transfer may now take place, increasing the overall thermal capacity of the heat exchanger 150.

It should be noted that indirect heat exchange section 155 may be located under the direct heat exchange section as shown in FIGS. 4, 5 & 6 with the air being drawn generally upwards through the direct heat exchange section and is not a limitation of the invention.

An advantage of having indirect heat exchange section 155 and direct heat exchange section 154 located within improved heat exchanger 150 is that the piping between indirect heat exchange section 155 and water distribution assembly 153 is minimized and customer piping is eliminated.

Figure 8:
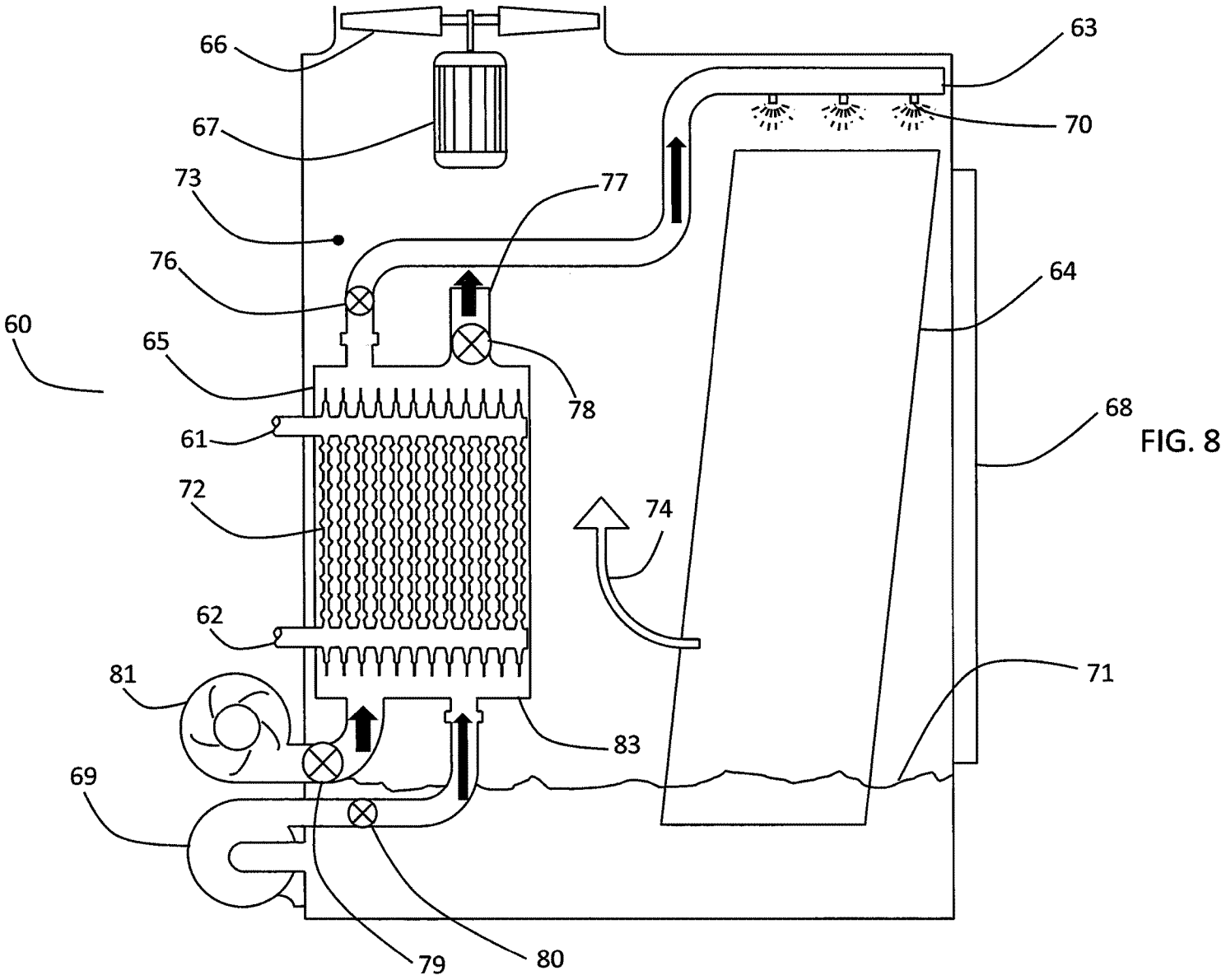
FIG. 8 is a side view of an eighth embodiment of a heat exchanger in accordance with the present invention.

Referring now to FIG. 8 of the drawings, an eighth embodiment of the present invention is shown generally as heat exchanger 60, which is generally in the form of a closed circuit cooling tower. Such heat exchanger generally is present in a closed circuit cooling tower with indirect heat exchange section 65 located in plenum 73 adjacent to and towards the lower half of direct heat exchange section 64. It should be noted that indirect heat exchanger 65 can be located above, below or adjacent to direct heat exchanger 64 as shown in other Figures but is presented as adjacent to direct heat exchanger 64 for illustrative purposes.

Direct heat exchange section 64 is typically comprised of fill usually comprised of sheets of polyvinyl chloride. Direct heat exchange section 64 receives air through air inlet 68 on the outside of heat exchanger 60, with air being drawn generally across and somewhat upwardly through direct heat exchange section 64 by fan 66 rotated by motor 67. It should be noted that indirect heat exchange section 65 may be located under the direct heat exchange section as shown in FIGS. 4, 5 & 6 with the air being drawn generally upwards through the direct heat exchange section and is not a limitation of the invention.

Indirect heat exchange section 65 is usually comprised of a plurality of plate type heat exchangers 72 positioned in housing 83 having internal fluid inlet 61 and fluid outlet 62.

It should be understood that the operation of fluid inlet 61 and fluid outlet 62 can be reversed if it is desired.

An evaporative cooling tower liquid, usually water, flows downwardly from water distribution assembly 63 such that the evaporative cooling tower liquid falls downwardly onto and through direct heat exchange section 64. While falling downwardly onto and through direct heat exchange section 64, a small portion of cooling tower liquid is evaporated by moving air and latent heat transfer takes place from cooling tower liquid to air. It should be noted that in some applications, condensation takes places from air into cooling tower liquid.

The evaporative cooling tower liquid that passes downwardly onto and through direct heat exchange section 64 and collected in sump 71 is pumped by pump 69 to housing 83 then through indirect heat exchange section 65 then back to water distribution assembly 63. Water distribution assembly 63 can be comprised of a variety of pipes with openings, orifices or nozzles 70, or any other water distribution arrangement such as using spray nozzles, troughs, or other water distribution assemblies.

Indirect heat exchange section 65 is usually comprised of a plurality of plate type heat exchangers 72 but can be any type of indirect heat exchanger such as and not limited to a coil circuit tube type heat exchanger as known in the art. A fluid to be cooled, condensed, heated, or evaporated passes within the joined plates or cassettes of plate type heat exchangers 72.

Air 74 exits from direct heat exchange section 64 into plenum 73. Air 74 on the way to fan 66 flows over housing 83 of indirect heat exchange section 65 and heat transfer takes place. In the case in which direct heat exchange section 64 is used to cool evaporative cooling tower liquid, air 74 cools housing 83 of indirect heat exchange section 65 which in turn cools the evaporative cooling tower liquid and then plate type heat exchangers 72 inside indirect heat exchange section 65.

Embodiment 60 has a wet and a dry mode of operation to cool indirect heat exchanger 65. During wet operation, air valves 78 and 79 are closed and air blower fan 81 is turned off while liquid valves 76 and 80 are open. Air valves 78 and 79, and also water valves 76 and 80 may be manually or automatically operated as known in the art and is not a limitation of the invention. During dry operation, liquid valves 76 and 80 are closed and air valves 78 and 79 are opened. Alternatively, air outlet valve 78 and water valve 76 may be omitted and air may discharge through distribution 63. During dry operation fan motor 67 is turned off and air blower fan 81 blows cold ambient air into housing 83 of indirect heat exchange section 65. Cold, ambient air cools down the plurality of plate type heat exchangers 72 using sensible heat transfer and the heated air exits through air exit 77 and then to outside of heat exchanger 60.

An advantage of having indirect heat exchange section 65 and direct heat exchange section 64 located within the improved heat exchanger 60 is that the piping between indirect heat exchange section 65 and water distribution assembly 63 is minimized and customer piping is eliminated.

Figure 10:
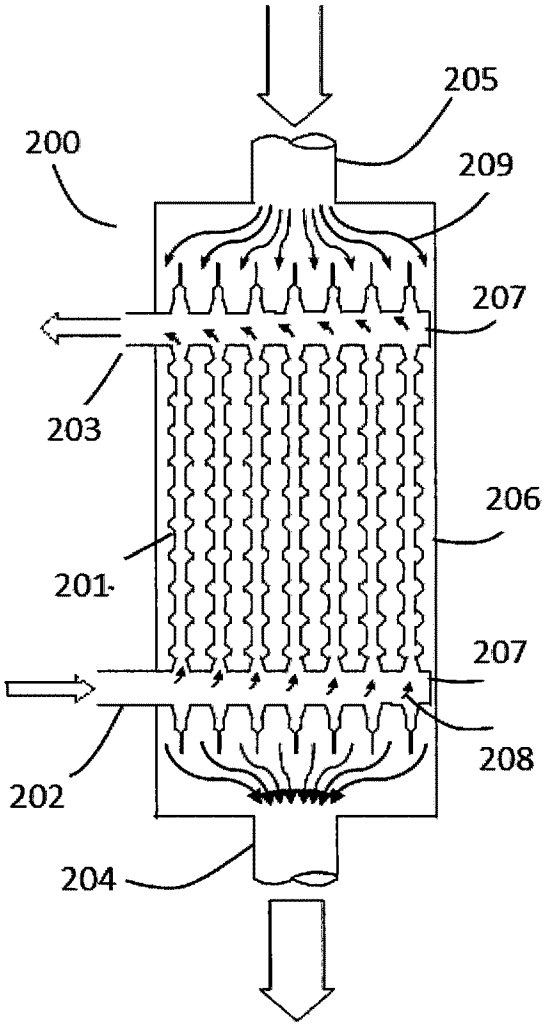
FIG. 10 is a cutaway view of the indirect heat exchange section having a plate type heat exchanger located inside a housing in accordance with an embodiment of the present invention
Figure 9:
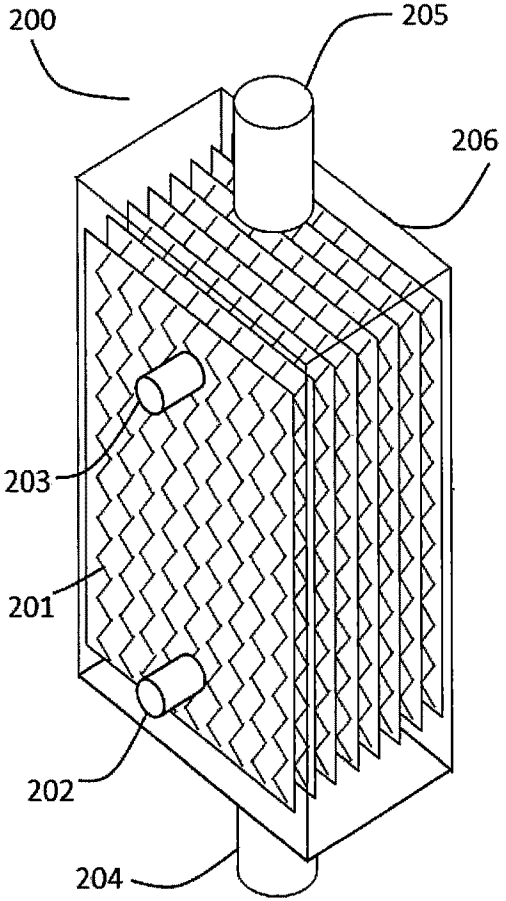
FIG. 9 is a perspective view of the indirect heat exchange section having a plate type heat exchanger located inside a housing in accordance with an embodiment of the present invention.

Referring now to FIGS. 9 and 10, a perspective view and a cutaway side view, respectively, of indirect heat exchange section 200 in accordance with the present invention are shown.

Indirect heat exchange section 200 is shown to be comprised of a plurality of plate type heat exchangers 201, process fluid inlet 202, process fluid outlet 203, evaporative cooling tower fluid outlet 204 and inlet 205, inlet and outlet plate header end caps 207 and housing 206. It should be understood that the operation of the internal process fluid inlet 202 and process fluid outlet 203 can be reversed if it is desired.

Internal, closed circuit cooling tower process fluid enters the plurality of plate type heat exchangers 201 through process fluid inlet 202 and is separated from the exterior of the plurality of plate type heat exchangers 201 and from the evaporative cooling tower fluid that enters through cooling tower fluid inlet 205 of housing 206. Housing 206 may be designed such that it can be easily removed for cleaning the exterior of plate type heat exchangers 201 and is not a limitation of this invention.

As shown by directional arrows 208, internal process fluid flows through a plurality of internal parallel passageways of plate type heat exchangers 201 and exits through process fluid outlet 203. As shown by cooling tower fluid directional arrows 209, exterior evaporative cooling tower fluid enters housing 206 through fluid inlet 205 and flows through a plurality of external passageways within plate type heat exchangers 201 and comes out of housing 206 through fluid outlet 204.

While flowing through the plurality of passageways within plate type heat exchangers 201, sensible heat transfer takes place between the evaporative cooling tower fluid and plate type heat exchangers 201.

In all the embodiments of the present invention, plate type heat exchanger 201 can be comprised of various metals such as stainless steel or other corrosion resistant steels and alloys. It is also possible that such plates can be comprised of other materials that would lead to good heat exchange between the fluid within the plate and the evaporative cooling tower liquid or air passing outwardly therefrom. Such materials could be aluminum or copper; various alloys, or plastics that provide corrosion resistance and good heat exchange and are not a limitation of the invention.

Figure 11:
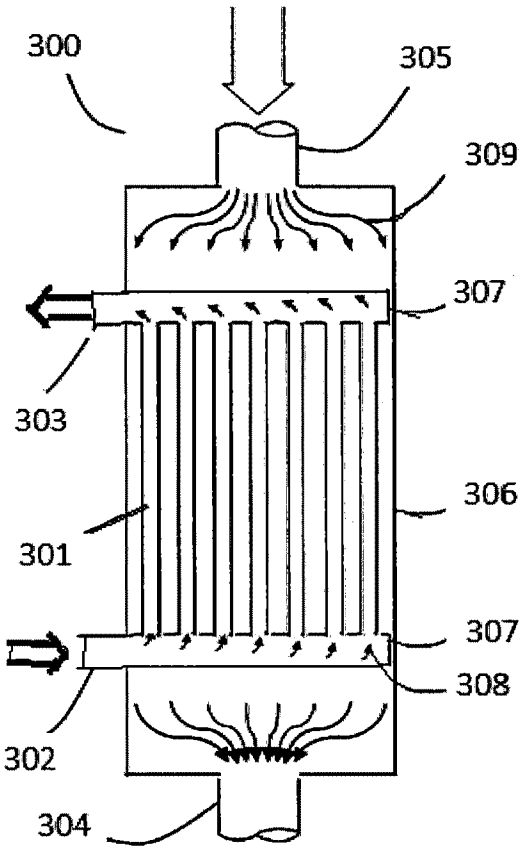
FIG. 11 is a cutaway view of the indirect heat exchange section having a coil circuit tube type exchanger located inside a housing in accordance with an embodiment of the present.

Referring now to FIG. 11, a side view of a coil circuit tube type heat exchanger of indirect heat exchange section 300 in accordance with the present invention is shown.

Indirect heat exchange section 300 is shown to be comprised of a plurality of coil circuit tube type heat exchangers 301, process fluid inlet 302, process fluid outlet 303, evaporative cooling tower fluid outlet 304 and inlet 305, inlet and outlet header end caps 307 and housing 306. It should be understood that the operation of the internal process fluid inlet 302 and process fluid outlet 303 can be reversed if it is desired.

Internal, closed circuit cooling tower process fluid enters the plurality of coil circuit tube type heat exchange 301 through process fluid inlet 302 and is separated from the exterior of the plurality of coil circuit tube type heat exchangers 301 and from the evaporative cooling tower fluid that enters through cooling tower fluid inlet 305 of housing 306. Housing 306 may be designed such that it can be easily removed for cleaning the exterior of coil circuit tube type heat exchangers 301 and is not a limitation of this invention.

As shown by directional arrows 308, internal process fluid flows through a plurality of internal parallel passageways of coil circuit tube type heat exchangers 301 and exits through process fluid outlet 303. As shown by evaporative cooling tower fluid directional arrows 309, exterior evaporative cooling tower fluid enters housing 306 through fluid inlet 305 and flows through a plurality of external passageways within plate type heat exchangers 301 and comes out of housing 306 through fluid outlet 304.

While flowing through the plurality of passageways within plate type heat exchangers 301, sensible heat transfer takes place between the evaporative cooling tower fluid and coil circuit tube type heat exchangers 301.

In all the embodiments of the present invention, coil circuit tube type heat exchangers 301 can be comprised of various metals such as stainless steel or other corrosion resistant steels and alloys. It is also possible that such tubes can be comprised of other materials that would lead to good heat exchange between the fluid within the plate and the evaporative cooling tower liquid or air passing outwardly therefrom. Such materials could be aluminum or copper; various alloys, or plastics that provide corrosion resistance and good heat exchange and are not a limitation of the invention.

What is claimed is:

1. A method of exchanging heat comprising the steps of:

providing a structure containing a direct evaporative heat exchange section, an indirect heat exchange section, and an evaporative liquid distribution assembly, the indirect heat exchange section having a housing with an evaporative liquid inlet and an evaporative liquid outlet, the indirect heat exchange section including an indirect heat exchanger in the housing, the indirect heat exchanger having a plurality of internal passageways configured to conduct an internal fluid stream, the evaporative liquid distribution assembly including a conduit connected to the evaporative liquid outlet of the housing, the direct heat exchange section comprising an air inlet and an air outlet, directing an evaporative liquid into the housing of the indirect heat exchange section via the evaporative liquid inlet, through a plurality of external passageways of the indirect heat exchanger, and exiting from the evaporative liquid outlet of the housing, wherein indirect heat exchange occurs between the internal fluid stream in the internal passageways of the indirect heat exchanger and the evaporative liquid in the external passageways of the indirect heat exchanger, directing the evaporative liquid from the evaporative liquid outlet of the housing to the conduit of the evaporative liquid distribution assembly;

distributing the evaporative liquid onto and through the direct heat exchange section from the evaporative liquid distribution assembly, the evaporative liquid distribution assembly being downstream from the indirect heat exchange section in the direction of flow of the evaporative liquid, operating a fan assembly to move air in the structure including moving air between the air inlet and the air outlet of the direct heat exchange section, the air moving through the direct heat exchange section directly exchanging heat with the evaporative liquid moving through the direct heat exchange section;

contacting an outer surface of the housing with air moved by the fan assembly, the evaporative liquid, or a combination thereof to transfer heat relative to the housing;

wherein directing the evaporative liquid into the housing of the indirect heat exchange section includes using an evaporative fluid pump to pump the evaporative liquid to the evaporative liquid inlet of the housing; and wherein air is pumped into the indirect heat exchange housing and through the exterior passageways of the indirect heat exchanger when the evaporative fluid pump is off to sensibly cool the indirect heat exchanger.

2. The method of exchanging heat of claim 1, wherein the indirect heat exchanger includes a plate heat exchanger.

3. The method of exchanging heat of claim 1, further comprising:

collecting the evaporative liquid that exits the direct heat exchange section in a sump, and wherein using the evaporative fluid pump to pump the evaporative liquid to the evaporative liquid inlet of the housing includes pumping collected evaporative liquid to the evaporative liquid inlet of the indirect heat exchange section housing.

4. The method of exchanging heat of claim 1 wherein the air moving through the direct heat exchange section moves generally cross-current to the direction of flow of the evaporative liquid through the direct heat exchange section.

5. The method of exchanging heat of claim 1 wherein the indirect heat exchange section is located adjacent to the direct heat exchange section.

6. The method of exchanging heat of claim 1, wherein directing the evaporative liquid into the housing of the indirect heat exchange section via the evaporative fluid inlet includes using the pump to force the evaporative liquid through the housing.

7. The method of exchanging heat of claim 6, wherein a velocity of the forced evaporative liquid moving through the housing is higher than that of a naturally flowing liquid by gravity.

8. The method of exchanging heat of claim 1, wherein the evaporative liquid is distributed through the plurality of external passageways of the indirect heat exchanger at a velocity greater than the natural flow of the liquid by gravity.

9. A method of exchanging heat using an apparatus comprising a direct evaporative heat exchange section, an indirect heat exchange section, and an evaporative liquid distribution assembly, the indirect heat exchange section having a housing and an indirect heat exchanger in the housing, the housing having an evaporative liquid inlet and an evaporative liquid outlet and being configured to conduct a fluid stream of evaporative fluid from the evaporative liquid inlet through a plurality of external passageways of the indirect heat exchanger to the evaporative liquid outlet, the direct heat exchange section comprising an air inlet and an air outlet, the evaporative liquid distribution assembly including a conduit connected to the evaporative liquid outlet of the housing, the method comprising:

directing an evaporative liquid into the indirect heat exchange section housing via the evaporative liquid inlet, through the external passageways of the indirect heat exchanger to exit from the evaporative liquid outlet of the indirect heat exchange housing, wherein indirect heat exchange occurs between a fluid stream in a plurality of internal passageways of the indirect heat exchanger and the evaporative liquid in the external passageways of the indirect heat exchanger, directing the evaporative liquid from the evaporative liquid outlet of the indirect heat exchange housing to the conduit of the evaporative liquid distribution assembly, distributing the evaporative liquid from the evaporative liquid distribution assembly onto and through the direct heat exchange section, the evaporative liquid distribution assembly being downstream from the indirect heat exchange section housing in the direction of flow of the evaporative liquid, operating a fan assembly to move air including moving air between the air inlet and the air outlet of the direct heat exchange section, the air moving through the direct heat exchange section directly exchanging heat with the evaporative liquid moving through the direct heat exchange section;

contacting an outer surface of the indirect heat exchange section housing with air moved by the fan assembly, the evaporative liquid, or a combination thereof to transfer heat relative to the housing;

wherein directing an evaporative liquid into the indirect heat exchange section housing via the evaporative liquid inlet includes using an evaporative fluid pump to pump the evaporative liquid to the evaporative liquid inlet of the housing; and wherein air is pumped into the indirect heat exchange housing and through the indirect heat exchange section when the evaporative fluid pump is off to sensibly cool the indirect heat exchange section.

10. The method of exchanging heat of claim 9, wherein the indirect heat exchanger includes a plate heat exchanger.

11. The method of exchanging heat of claim 9, further comprising: collecting the evaporative liquid that exits the direct heat exchange section, and pumping the collected evaporative liquid to the evaporative liquid inlet of the indirect heat exchange section housing.

12. The method of exchanging heat of claim 9 wherein the air moving through the direct heat exchange section moves generally cross-current to the direction of flow of the evaporative liquid through the direct heat exchange section.

13. The method of exchanging heat of claim 9 wherein the indirect heat exchange section is located adjacent the direct heat exchange section.

14. The method of exchanging heat of claim 9, wherein distributing the evaporative liquid from the water distribution assembly onto and through the direct heat exchange section includes using the pump to force the evaporative liquid through the housing.

15. The method of exchanging heat of claim 14, wherein a velocity of the forced evaporative liquid moving through the housing is higher than that of a naturally flowing liquid by gravity.

16. The method of exchanging heat of claim 9, wherein the evaporative liquid is distributed through the plurality of external passageways of the indirect heat exchange section at a velocity greater than the natural flow of the liquid by gravity.

17. The method of claim 9 wherein the direct heat exchange section includes fill sheets.

18. A cooling tower comprising:

a direct evaporative heat exchange section;

an evaporative liquid distribution assembly configured to distribute evaporative liquid onto the direct evaporative heat exchange section, the evaporative liquid distribution assembly including a conduit;

a fan assembly operable to move air including moving air through the direct evaporative heat exchange section to exchange heat between the air and the evaporative liquid moving through the direct evaporative heat exchange section;

an indirect heat exchange section comprising:

a housing having an evaporative liquid inlet and an evaporative liquid outlet, the evaporative liquid outlet connected to the evaporative liquid distribution assembly conduit so that the housing is upstream of the evaporative liquid distribution assembly in the direction of flow of the evaporative liquid;

the housing having an outer surface configured to be contacted by air moved by the fan assembly, the evaporative liquid, or a combination thereof to transfer heat relative to the housing;

an indirect heat exchanger in the housing, the indirect heat exchanger comprising:

an inlet to receive an internal fluid stream;

a plurality of internal passageways for the internal fluid stream;

an outlet for the internal fluid stream;

a plurality of external passageways for the evaporative liquid in the housing;

wherein the indirect heat exchanger is configured to separate the internal fluid stream in the internal passageways of the indirect heat exchanger from evaporative fluid in the external passageways of the indirect heat exchanger;

a sump configured to collect evaporative liquid from the direct evaporative heat exchange section;

an evaporative liquid pump operable to pump the collected evaporative liquid to the evaporative fluid inlet of the housing, through the external passageways of the indirect heat exchanger in the housing, out the evaporative fluid outlet of the housing, and into the conduit of the evaporative liquid distribution assembly; and an air source operable to direct air into the indirect heat exchange section housing.

19. The cooling tower of claim 18 further comprising an outer structure; and wherein the direct heat exchange section and indirect heat exchange section are in the outer structure.

20. The cooling tower of claim 18 wherein the indirect heat exchanger includes a plurality of plates, a plurality of tubes, or a combination thereof.

21. The cooling tower of claim 18 wherein the direct heat exchange section includes fill sheets.

22. The cooling tower of claim 18 wherein the indirect heat exchange section includes at least one valve operable to selectively permit either the evaporative liquid to flow into the evaporative liquid inlet of the housing or air from the air source to enter the housing.

23. The cooling tower of claim 22 wherein the cooling tower has a wet operating mode wherein the evaporative liquid pump is operated and the at least one valve permits the evaporative liquid to flow into the evaporative liquid inlet of the housing; and wherein the cooling tower has a dry operating mode wherein the at least one valve permits the air from the air source to enter the housing.

* * * * *